United States Patent [19]

DeMent

[11] Patent Number: 4,892,223

[45] Date of Patent: Jan. 9, 1990

[54] PROCESS OF MAKING A LINED CONTAINER AND THE PRODUCT

[75] Inventor: David L. DeMent, Millersport, Ohio

[73] Assignee: Unipac, Inc., Hebron, Ohio

[21] Appl. No.: 269,159

[22] Filed: Nov. 9, 1988

[51] Int. Cl.[4] ..... B65D 25/00

[52] U.S. Cl. ..... 220/404; 229/23 A

[58] Field of Search ..... 220/404, 1 T; 229/23 A

[56] References Cited

U.S. PATENT DOCUMENTS

| | | | |
|---|---|---|---|
| 783,971 | 2/1905 | Meinecke et al. . | |
| 2,459,727 | 1/1949 | Tillery | 229/23 A |
| 2,463,313 | 3/1949 | Ringler . | |
| 2,736,065 | 2/1956 | Wilcox . | |
| 3,128,904 | 4/1964 | Reilly . | |
| 3,169,086 | 2/1965 | Meissner . | |
| 3,416,495 | 12/1968 | Wilson . | |
| 3,484,017 | 12/1969 | O'Donnell | 220/404 X |
| 3,576,290 | 4/1971 | Marchisen | 220/404 |
| 3,684,155 | 8/1972 | Smith | 220/404 |
| 3,817,444 | 6/1974 | Yoch | 220/404 X |
| 4,687,462 | 8/1987 | Rewitzer . | |

*Primary Examiner*—Steven M. Pollard

*Attorney, Agent, or Firm*—Sidney W. Millard

[57] ABSTRACT

A lined container is formed by providing a tubular structure having vertically extending sides, a top edge and a bottom edge. Horizontal slits are formed in the side walls with the slits being near the top edge. A flexible bag liner is inserted in the container and the open end is pulled around the outside top surface of the tubular container and the edges are stuffed through the slits which frictionally hold the liner in operative position.

18 Claims, 3 Drawing Sheets

PROCESS OF MAKING A LINED CONTAINER AND THE PRODUCT

FIELD OF THE INVENTION

This invention relates to trash containers to be lined with conventional plastic trash bags, the process for making the same and with the outer shell being reusable.

BACKGROUND OF THE INVENTION

Waste containers are common on city streets, amusement park walkways, restaurants and the like. Many are lined with plastic liners which are designed to collect the deposited trash, be removed to a trash dump and the outer shell of the container will be relined with an additional plastic liner.

The problem often experienced by the maintenance workers in charge of the container is securing the plastic liner to the container by some means where the liner will not be pulled into the container by the trash being deposited.

One way this is accomplished is to insert the bag into the container with the open end of the liner bag extending upwardly and being pulled over the edge of the top lip of the container shell and then down the outside of the shell in an inverted U-shaped design. A lip or top which fits over the trash container shell is placed over the top of the container and a closely fitting set of flanges sandwiches the liner top between a lip on the container lid and the side wall of the container shell. This is a perfectly satisfactory way of insuring that food and beverage trash which is deposited in the container through suitable openings in the lid will not pull the liner into the container. However, it is a time consuming chore, an expensive trash container and food and other liquid trash being deposited will tend to collect on exposed surfaces of the lid.

While this type of lined trash container may be economically practical in a stationary work area it is too expensive for periodic street fairs and the like where hundreds of trash containers are needed. Between annual street fairs a city or village may not need the expensive rigid containers and storage space may be limited.

There is a need for a simple reusable, inexpensive trash container which allows easy and quick replacement of the liner and which will not have a lid where garbage will coat the sides of the permanent structure. Additionally, there is a need for such a container which will fold up to minimize the need for storage space Fiberboard containers have previously been suggested for reusable trash container shells but no suitable way has been suggested for locking the plastic liner to the upper edge of the open shell. Ways used previously include taping, stapling, hand tying the upper edge of the plastic liner in a knot to try to pull the outside portion of the liner tightly against the shell exterior. However, what happens very quickly with the tied liner is that one edge of the liner will be pulled into the container by the deposition of some heavy object such as a half full container of soft drink and then people simply drop their trash into the container which tends to pull the liner further down into the container shell and the garbage simply collects on top of the liner. The result is that the side walls of the container shell are contaminated by food and liquids and the fiberboard container becomes unusable. With tape and staples the attaching chore is time consuming and removal of the filled bag systemically destroys the top of the fiberboard container as each successive staple is ripped out.

SUMMARY OF THE INVENTION

As a result of experiments in making fiberboard, plastic, metal, etc. containers to be lined with conventional plastic trash bags, it has been discovered that the trash bags can be frictionally locked to the fiberboard container by providing horizontal slits in the side walls of the container and stuffing a portion of the liner bag through the slits from the outside of the container side walls to the inside. Thereby, the lips of the slit frictionally engage the surface of the plastic liner and prevent the top of the liner from being dragged into the container cavity.

Various shapes of container shell have been considered and the inventive concept will work with essentially any shape including a cylindrical shell, a frustroconical shell, a square shell and a polygonal shell.

In addition, it has been found that specific structure on the bottom of the shell can be incorporated to increase the useful life of the fiberboard shell by keeping the cut edge of the fiberboard out of direct contact with the grass, sidewalk or other supporting surface. Additionally, the structure used provides greater stability for the shell itself where the supporting substrate is not always completely flat.

The specific bottom structure in question includes flaps on the bottom edge of the container side wall and the flaps are folded inwardly and upwardly into the shell cavity. A bottom support structure with downwardly extending flaps mates with the wall flaps to form a shelf to support the bottom of the plastic bag. Thereby, the bottom edge of the side wall which will contact the supporting substrate will be a closed paper wall rather than the end of a corrugated fiberboard panel. The end of a corrugated fiberboard panel exposes the open spaces of the paper corrugation and the end of the paper sheets covering each side thereof, and when placed in water the open end of the fiberboard acts as a wick tending to draw water into the end of the fiberboard. On the other hand, with the closed paper wall which is formed by the bent area of the flap, the fiberboard surface which will be in contact with the same water will not act as a wick to the same extent. Thereby, the fiber container will have a longer life. To minimize water absorption to the exposed surfaces of the container shell and bottom support surface, a weather proofing coating may be applied.

Objects of the invention not clear from the above description will be understood by a review of the drawings and a description of the preferred embodiments which follow.

DESCRIPTION OF THE PREFERRED EMBODIMENT

Figure 1:
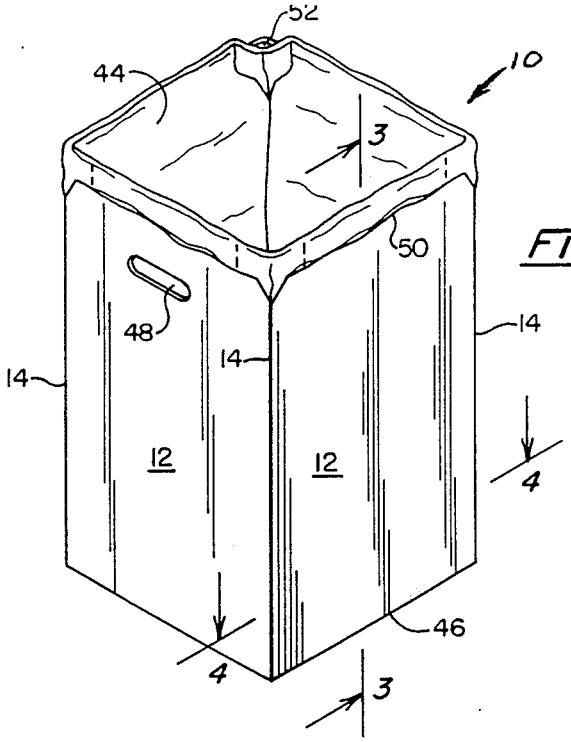
FIG. 1 is a perspective view of a lined fiberboard trash container.

FIG. 1 shows a lined container or box 10 of fiberboard. In this case the container is illustrated having four side walls 12 joined together at four corners 14. The four side panels 12 are planer in structure and together form a tube which is open at the top and the bottom, best seen in FIG 3.

Figure 5:
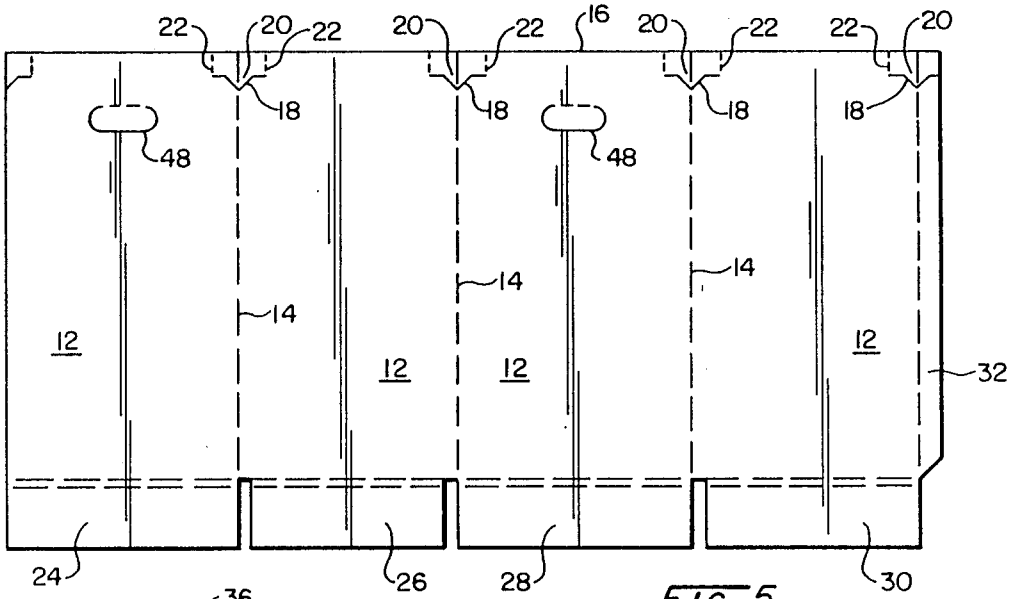
FIG. 5 is a plan view of a flat fiberboard panel cut and fold line imprinted prior to being folded to form the container shell shown in FIG. 1.

The box 10 is formed from a fiberboard blank cut as shown in FIG. 5. The top edge 16 of the container is planer. Near the top edge are a plurality of slits 18. In this preferred embodiment each horizontally extending slit 18 is shown with a V-shaped portion 20 in its middle part with the apex of the downwardly extending V being located at each corner thereby forming a downwardly extending tooth. Score lines 22 are formed between the upper edge 16 and the end points of the slits, for reasons which will be clear subsequently.

At the lower ends of each of the panels 12 is a flap 24, 26, 28, 30 but it will be observed that the transverse edges of flaps 24 and 28 extend right to the corner score line 14. However, the side edges of flaps 26 and 30 do not. A one-half inch gap is provided between adjacent flaps and that one-half inch is cut from each side of flap 26 and 28 and in the preferred embodiment the transverse width of panels 12 and flaps 24 and 28 is nineteen and three-eighths inches. Whereas, the transverse length of flaps 26 and 30 is eighteen and three-eighths inches.

Figure 4:
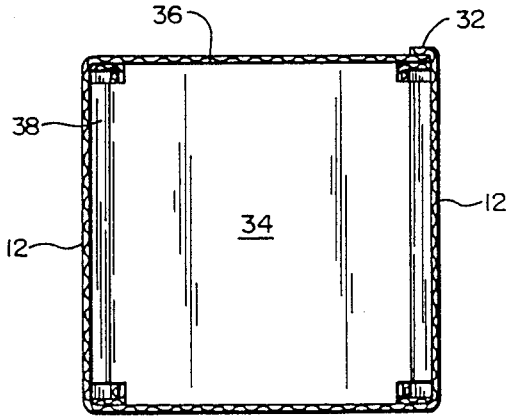
FIG. 4. is a sectional view of the container of FIG. 1 taken along line 4—4.

Note also in FIG. 5 the overlapping edge flap 32 which overlaps the panel to the far left when the panels are formed into the tube shown in FIG. 4.

Figure 6:
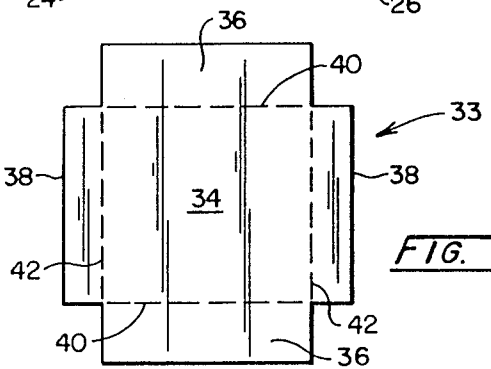
FIG. 6 is a top plan view of a fiberboard blank cut and fold line imprinted prior to deformation to form the interior plastic bag support inside the fiberboard shell.

Looking now to FIG. 6, a bottom support 33 is cut from a planer corrugated fiberboard and it will have a central flat section 34, two long flaps 36 and two short flaps 38. Note that the score lines 40, 42 shown in dash lines in Fig. 6. When the flaps 36 and 38 are folded downwardly the flat section 34 is designed to fit inside the tube formed by the side walls 12.

It should be noted that the bottom or female side of the planer support 33 is coated with a waterproofing polymer which tends to shed water for purposes of avoiding absorption of water. The same is true of the exterior surface of the side walls 12.

It will be observed that the width of the flaps 36 (the horizontal dimension as shown in FIG. 6) is eighteen and five-eighths inches and the vertical dimension as viewed in FIG. 6 from the score line 40 to the top edge is three and one-half inches. The size of flaps 38 is sixteen and five-eighths by three and one-half inches. The vertical dimension from score line 40 to score line 40 is sixteen and five-eighths inches; the horizontal dimension from score line 42 to score line 42 is eighteen and five-eighths inches. The reason for the dimensional relationships is the assembly sequence which provides dimensional and structural stability to the rectangular tube forming the repository for trash.

After the blank shown in FIG. 5 is prepared it is assembled by breaking the fold lines 14 and adhesively bonding flap 32 over the outside edge of the left-hand side panel 12 as shown in FIG. 5. Then the long flaps 24 and 28 are folded upward into the tube. Next the short flaps 26 and 30 are folded upward. The shorter dimensions of flaps 26 and 30 are necessary to aocommodate the increased thickness of the bottom side wall which results from the previously upturned flaps 24 and 28.

Next the bottom support 33 shown in FIG. 6 is assembled into place. Each flap 36, 38 is deformed downward along the appropriate score line. Flaps 38 adjoin the long dimension of the bottom support 34 and accordingly flaps 38 are sandwiched between the side walls 12 and the long dimensioned flaps 24 and 28 of the side wall. Flaps 36 are sandwiched between the short dimensioned flaps 26, 30 on the bottom edge of the side walls 12. The bottom support 33 will be assembled in operative position by insertion into the tube from the top edge 16 downwardly.

In an alternative assembly procedure, the tube may be inverted and flaps folded into place as stated above. Then the bottom is processed by breaking at score lines 40, 42. Long flaps 36 are folded over oto the female side of the support 34 while the shorter flaps remain extending radially outward. Flaps 36 are grasped manually and the support 33 is forced through the open bottom of tube 10. After flaps 38 slide past flaps 26, 30 they will spring outward to engage sidewalls 12. Thus, when the flaps 36 are pulled upward the flaps 38 will slide behind flaps 26, 30 while flaps 36 will not be behind flaps 24, 28. Flaps 38 will be sandwiched between sidewall 12 and flaps 26, 30. Flaps 24, 28 will be sandwiched between flaps 36 and side wall 12.

When the trash container is not being used it may be stored in flat condition by removing the bottom support 33 and aligning flaps 36 and 38 to a flat condition. The tubular structure may also be stored flat by spreading the flaps 24, 26, 28, 30 to the position shown in FIG. 5 and pushing one corner toward its diagonally opposite corner until the tube is flat.

Figure 2:
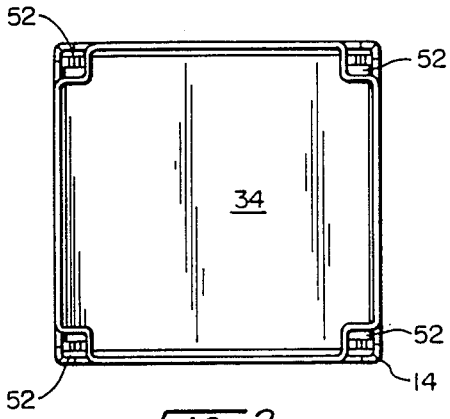
FIG. 2 is a top plan view of the trash container of FIG. 1 without the liner.
Figure 3:
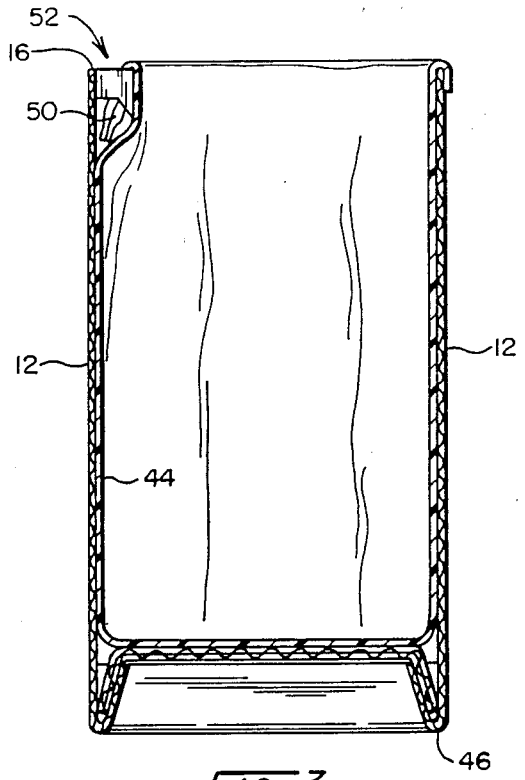
FIG. 3 is a sectional view of the container of FIG. 1 taken along line 3—3.

Looking now to FIG. 1–3, a conventionally sized plastic trash bag or liner bag 44 is shown mounted in the tube and locked to its upper end. FIG. 3 shows the closed bottom of the bag 44 resting on the flat support surface 34 such that is up and away from the supporting substrate where the lower edge or bottom edge 46 will engage the grass, ground, floor tile or whatever supporting substrate is available. This allows the container to be pulled along the substrate by hand holes 48 without dragging the closed bottom of the bag along the substrate. Thereby, the bag will not be torn by the friction or uneven surface of the substrate. Indeed, the bag will not even be in contact with the substrate. The fact that the bottom edge 46 of the container presents essentially line contact with the supporting substrate is another benefit; should the bottom of the container be flat as with a conventional fiberboard container, the fiberboard trash container might not sit easily on uneven ground. Looking to FIG. 3 it will be clear that the recessed bottom support could accommodate a rock which might be on the ground without impairing the stability of the container resting of the ground around the rock. The fact that the lower edge 46 engages the supporting substrate only at the periphery of the trash container makes the trash container more stable when it is used on uneven surfaces.

In assembling bag 44 into the assembled fiberboard container, it is first inserted into the container from the top as shown in FIG. 2 and with the corners of the container 10 at the top edge flexed inward. The open top of the bag edge 50 is pulled over the top edge 16 of the fiberboard container and down the outside a certain distance to form an inverted U-shape over the upper edge 16.

Next a portion of the top open edge 50 of the plastic bag liner is pulled through the open mouth 52 formed by the slit 18. Then pressure is applied on the inside surface of the corner 14 immediately above the slits 18 to flex the side wall back out into its original position and thereby trap a small portion of the bag liner between the lips of the slit 18. Thereby, the bag liner will be secured by frictional engagement by the lips of the slit and prevented from sliding into the tube when trash is deposited therein. It is preferred that the open edge portion 50 not extend out of the slit down the outside of the wall panels 12 below slit 18; the lock is more secure with the edge 50 inside the tube locked in place by tooth 20.

It has been discovered by experimentation that the bag liner will be held securely in place by engagement with two slits, three slits is even better, and obviously if a square or rectangular tube is used, slits at all corners would be the most efficient. However, it is not required that the slits necessary be at the corners to be effective but corner slits are the most effective.

Additionally, it has been discovered that the configuration of the slits themselves can be important in holding capacity and preventing the bag 44 from sliding into the tube, and it is that tooth 20 be formed at the middle part of the slit. The tooth preferred is a downwardly converging V-shape with the apex of the V being at the corner break line 14.

The spacing of the slit 18 from the top edge 16 of the fiberboard container has been found to be critical. With a standard double-ply thickness of fiberboard the slit should not be closer to top edge 16 than about one-half inch. Whereas, with single-ply fiberboard the slit should be no closer than about one and one-half inches. The reason is that with repeated uses of the container and replacement bag liners, slits closer than indicated tend to pull out prematurely and once the slit locking structure tears out of the container it becomes no more effective than any conventional fiberboard box.

The language in the industry is well defined and basically there are four different flutes manufactured with at least nine facings so there is a variety of fiberboard that will work. On the high end is double-wall six hundred pound bursting strength and on the lower end is the single-wall, one hundred twenty-five pound bursting strength. Paper standards are well established in the industry and will not be discussed here as the standards are well known. Where the word "double-wall" is used the reference is to the number of pieces of paper used in making the fiberboard (regardless of the thickness of the paper itself). For example, "double-wall" uses five pieces of paper bonded together in the following sequence, flat paper—fluted paper—flat paper—fluted paper—flat paper. Single ply includes three layers with a fluted layer sandwiched between two flat layers. It is within the concept of this invention to use triple-wall fiberboard.

Having described the inventions in their preferred embodiment it will be clear that certain modifications may be made to the inventions without departing from the spirit thereof. It is not intended that the language used to describe the inventions in the specification nor the drawings used to illustrate the same be limiting on the invention. Rather it is intended that the inventions be limited only by the scope of the appended claims.

I claim:

1. A container comprising, a vertically extending side configured to form a vertically extending fiberboard tube having multiple corners which is open at the top, a liner bag located in said tube, the liner being closed at the bottom and open at the top, means for mechanically locking the liner to the upper end of the tube, said locking means comprising at least two horizontal slits through the vertical side, and spanning at least two of said corners, a score line extending vertically from each end of each slit to the top of the tube, said score lines serving as hinges for the flexing of the strip of sidewall between the slit and the top of the container, the straight line distance between the ends of each slit being less than the length of the slit along the vertical side, said slits being spaced from said top a distance greataer than about one-half inch when the container is formed of double wall fiberboard and greater than about one and one-half inches when the container is formed of single wall fiberboarad, the open top of the liner bag extending from inside the tube, over the top of the tube, and down the outside of the tube, portions of the liner extending from outside the tube, through each of said slits and into the inside of the tube, the portions of the liner extending through said slits being frictionally engaged by the edges of the slits to minimize relative movement between the slit edges and the contacting portion of the liner.

2. The container of claim 1 wherein there are at least three slits in the side, each slit frictionally engaging a portion of the liner bag.

3. The container of claim 2 including a separable container bottom, said container bottom mounted inside the tube and being configured to support the liner bag bottom above the tube bottom.

4. The container of claim 3 wherein the tube bottom includes flaps folded inwardly and upwardly, the container bottom including downwardly extending flaps,

5. The container of claim 2 wherein the side comprises a plurality of planer panels joined together to form said tube.

6. The container of claim 5 wherein the panels are joined to form corners and each of the slits is at a corner.

7. The container of claim 6 including a separable container bottom, said container bottom mounted inside the tube and being configured to support the liner bag bottom above the tube bottom.

8. The container of claim 7 wherein the tube bottom includes flaps folded inwardly and upwardly, the container bottom including downwardly extending flaps, each downwardly extending flap being sandwiched between the side of the tube and an upwardly extending side flap.

9. The container of claim 1 wherein the side comprises a plurality of planer panels joined together to form said tube.

10. The container of claim 9 wherein the panels are joined to form corners and each of the slits is at a corner.

11. The container of claim 10 including a separable container bottom, said container bottom mounted inside the tube and being configured to support the liner bag bottom above the tube bottom.

12. The container of claim 11 wherein the tube bottom includes flaps folded inwardly and upwardly, the container bottom including downwardly extending flaps, each downwardly extending flap being sandwiched between the side of the tube and an upwardly extending side flap.

13. A container according to claim 10 wherein the slits include a V-shaped portion converging at the corners to form a locking tooth.

each downwardly extending flap being sandwiched between the side of the tube and an upwardly extending side flap.

14. The container of claim 1 including a separable container bottom, said container bottom mounted inside the tube and being configured to support the liner bag bottom above the tube bottom.

15. The container of claim 14 wherein the tube bottom includes flaps folded inwardly and upwardly, the container bottom including downwardly extending flaps, each downwardly extending flap being sandwiched between the side of the tube and an upwardly extending side flap.

16. A process for assembling a lined tubular container comprising, providing a tubular fiberboard container having a vertically extending side with multiple corners, a top edge and a bottom edge, said container having at least two horizontally extending slits in said side, and spanning at least two of said corners, a score line extending vertically from each end of each slit to the top of the tube, said score lines serving as hinges for the flexing of the strip of sidewall between the slit and the top of the container, the straight line distance between the ends of each slit being less than the length of the slit along the vertical side, said slits being spaced from said top a distance greater than about one-half inch when the container is formed of dougle wall fiberboard and greater than about one and one-half inches when the container is formed of single wall fiberboard, providing a flexible bag liner having a closed bottom and an open top, the open top of the bag terminating in a bag edge, inserting the bag into the container with the closed bottom of the bag nearest the bottom edge of the container and the bag edge near the top edge of the container, pulling the upper portion of the bag from inside the container over the top edge and then downwardly to form an inverted U-shape with the bag edge outside the container, pushing the container side inwardly at locations below the top edge and immediately above the slits to form openings through said side, said pushing being of a degree that the strip of fiberboard pushed will be displaced and remain displaced without mechanical pressure to allow the openings to remain open, inserting a portion of the bag edge through said openings, pushing the inside of said container side outwardly at said locations to close said openings and thereby frictionally lock said bag to said container said strip remaining in the outward position with the opening closed without outside mechanical force, and forming the tubular container from a plurality of planer panels joined together at their edges to form corners, cutting the slits at the corners with a V-shaped pattern with the apex of the V at the corner formed by two joined panels.

17. The process of claim 16 including forming a support for said bag bottom above the bottom edge of said side before the bag is mounted in the container, providing a plurality of flaps connected to said bottom edge, folding said flaps inwardly and upwardly into said container, providing a planer support having edge flaps, folding the edge flaps downwardly to conform the planer support to a shape generally corresponding to the shape formed by the container bottom edge, inserting the planer support into the container with its edge flaps sandwiched between the container side and the upwardly extending container flaps.

18. The process of claim 16 including cutting the slits completely through the side of the container where the slit extends no closer to the top edge than about one-half inch when the container is formed from double wall fiberboard and no closer than one and one-half inches when the container is formed from single wall fiberboard.

* * * * *